US005541839A

United States Patent [19]

Mitzkus et al.

[11] Patent Number: 5,541,839

[45] Date of Patent: Jul. 30, 1996

[54] INTERFACE ARRANGEMENT FOR DATA TRANSFER BETWEEN CARRIER AIRCRAFT AND MISSILE

[75] Inventors: Uwe Mitzkus, Owingen; Reiner Eckhardt, Überlingen, both of Germany

[73] Assignee: Bodenseewerk Geratetechnik GmbH, Germany

[21] Appl. No.: 328,060

[22] Filed: Oct. 24, 1994

[30] Foreign Application Priority Data

Oct. 23, 1993 [DE] Germany ..... 43 36 207.9

[51] Int. Cl.[6] ..... G06F 165/00; G06F 171/00; F41F 7/00

[52] U.S. Cl. ..... 244/3.16; 235/400

[58] Field of Search ..... 364/423; 244/3.15, 244/3.16; 395/882, 892; 348/117, 144, 145, 146; 235/400

[56] References Cited

U.S. PATENT DOCUMENTS

| | | | |
|---|---|---|---|
| 3,609,312 | 9/1971 | Higgins et al. | 235/150.2 |
| 4,660,170 | 4/1987 | Hui et al. | 364/900 |
| 5,034,686 | 7/1991 | Aspelin | 324/158 R |
| 5,036,466 | 7/1991 | Fitzgerald et al. | 364/423 |
| 5,214,584 | 5/1993 | Dingee et al. | 364/423 |
| 5,229,538 | 7/1993 | McGlynn et al. | 89/1.56 |
| 5,349,685 | 9/1994 | Houlberg | 395/800 |
| 5,377,109 | 12/1994 | Baker et al. | 364/424.06 |

FOREIGN PATENT DOCUMENTS 1355327 6/1974 United Kingdom .

*Primary Examiner*—Michael Zanelli

*Attorney, Agent, or Firm*—Lee, Mann, Smith, McWilliams, Sweeney & Ohlson

[57] ABSTRACT

The interface arrangement is provided for data transfer between a carrier aircraft and a missile which is to be launched from the carrier aircraft and which includes a target seeking head. The missile is connected to the carrier aircraft through a connecting cable which contains a small number of wires sufficient for transferring analog data and which is detachable upon launch. For selectively operating the carrier aircraft in conjunction with a missile which is equipped with either (i) a target seeking head producing analog target deviation data or (ii) a image processing target seeking head, at least two interfaces are connected to the connecting cable. One of the interfaces is designed for data transfer via the connecting cable to and from the target seeking head producing analog target deviation data. An other one of the interfaces is designed for data transfer via the connecting cable to and from a image processing target seeking head. A controller enables selective connection of the connecting cable to either one of the two interfaces. The controller responds to identifying signals signalling the type of target seeking head and automatically activating a respective one of the interfaces.

11 Claims, 5 Drawing Sheets

INTERFACE ARRANGEMENT FOR DATA TRANSFER BETWEEN CARRIER AIRCRAFT AND MISSILE

BACKGROUND OF THE INVENTION

The present invention relates to a new and improved interface arrangement for data or signal transfer between a carrier aircraft and a missile which is to be launched from the carrier aircraft and includes a target seeking head.

In its more particular aspects, the present invention particularly relates to a new and improved interface arrangement for data or signal transfer between a carrier aircraft and a missile which is to be launched from the carrier aircraft and includes a target seeking head connected to a carrier aircraft computer by means of a connecting cable which is designed to contain a small number of wires sufficient for transferring analog data or signals and which is detachable from the missile upon launch thereof from the carrier aircraft.

In one type of known target seeking missiles, particularly air-to-air missiles, the target seeking head produces analog data or signals as a function of the deviation of the target from an optical axis. In conventional missiles of this type, an imaging optical system is placed at a gyro rotor. The imaging optical system thus is decoupled from angular movements of the missile. The gyro rotor and the imaging optical system are disposed inside the tip of the missile behind a "dome" which is transparent for infrared radiation. The gyro rotor is universally supported within the missile. The optical axis of the imaging optical system forms a small angle with the rotational axis of the gyro rotor. The imaging optical system produces an image of a field of view in the plane of a modulating disc which is fixedly connected to the missile. The thus produced image performs a circulating movement relative to the modulating disc. An infrared-sensitive detector which is fixedly connected to the missile, is disposed behind the modulating disc at the pivot center of the gyro rotor. The detector produces frequency-modulated and amplitude-modulated analog data or signals which are a function of the deviation of a detected radiating target from the rotational axis of the gyro rotor.

The target seeking head contains means for continually laying the rotational axis of the gyro rotor at the target, such means constituting, for example, a precession coil surrounding a transversely magnetized gyro rotor. In the known target seeking heads, signals are applied to the precession coil in order to simultaneously derive a control signal for guiding the missile.

Such missile is disclosed in, for example, British Patent No. 1,355,327, published Jun. 5, 1974.

The missiles are conventionally disposed at a launcher. Prior to launching, the missile must be directed to a target and this is done by feeding prelaunch data or signals to the missile. For this purpose, the target seeking head of the missile and the carrier aircraft exchange information. In missiles of the aforedescribed type, in which the target seeking head operates using analog data or signals, this information consists of a small number of analog data or signals which are transmitted through the aforementioned connecting cable having the form of a three-wire connecting cable, for example. An interface is provided for receiving these signals and for connection to the carrier aircraft data bus. Such interface may be located immediately at the carrier aircraft. However, the interface may also be located at the launcher.

The target seeking head just described has a relatively small momentary field of view. In order to pick up a target, a scanning movement is imposed onto the target seeking head prior to launching so that the target seeking head will sweep a larger field of view for a target. The gyro rotor of the target seeking head carries out such scanning movement. However, the gyro rotor of the target seeking head may also be laid at a radar-detected target by means of a respective command issuing from a radar device present on the carrier aircraft.

More modern missiles comprise an image processing target seeking head. Such target seeking head produces a multitude of digital data or signals. These data or signals may be transmitted to the carrier aircraft data bus via a data line and a suitable interface.

Now, there are carrier aircraft adapted for data or signal interchange with missiles comprising image processing target seeking heads. Other carrier aircraft are adapted for data or signal interchange with missiles having target seeking heads which operate using analog data or signals in the manner as described hereinbefore. If the latter type of aircraft is intended to be operated in conjunction with missiles comprising more modern image processing target seeking heads, considerable modification or retrofitting is required during which new cables must be laid in the carrier aircraft.

SUMMARY OF THE INVENTION

Therefore, with the foregoing in mind it is primary object of the present invention to provide a new and improved interface arrangement for data or signal transfer between a carrier aircraft and a missile and which interface arrangement is not afflicted with the drawbacks and limitations of the prior art constructions heretofore discussed.

A specific object of the present invention is directed to the provision of a new and improved interface arrangement for data or signal transfer between a carrier aircraft and a missile and which interface arrangement permits operating a given carrier aircraft in conjunction with missiles equipped with different types of target seeking heads at minimum retrofitting expense.

It is a further important object of the present invention to provide a new and improved interface arrangement for data or signal transfer between a carrier aircraft and a missile and which interface arrangement permits operating a missile containing a given type of target seeking head in conjunction with a carrier aircraft which is equipped for processing data originating from a different type of target seeking head at minimum retrofitting expense.

Another significant object of the present invention resides in providing a new and improved interface arrangement for data or signal transfer between a carrier aircraft and a missile and which interface arrangement permits selectively operating a given carrier aircraft either with a missile equipped with an analog target seeking head or with a missile equipped with a image processing target seeking head.

Now in order to implement these and still further objects of the invention, which will become more readily apparent as the description proceeds, the interface arrangement of the present development is manifested by the features that, among other things, a data bus is connected via the connecting cable, on the side of the carrier aircraft, to at least two interfaces one of which is designed for data or signal transfer between the aircraft and a missile equipped with a target seeking head producing analog target deviation data or signals while an other one thereof is designed for data or signal transfer between the carrier aircraft and a missile equipped with a image processing target seeking head, the connecting cable can be selectively connected to the one or the other interface by means of respective control signals, signal transmitters are provided at the missile for signalling the type of target seeking head and automatically activating the one or the other interface, whereby the carrier aircraft is selectively operated in conjunction with either (i) a missile equipped with a target seeking head which produces analog target deviation data or signals or (ii) a missile equipped with an image processing target seeking head.

Thus, in accordance with the invention, the data or signal transfer is effected in all cases through one and the same connecting cable. This is permitted as a consequence of corresponding editing. Depending upon whether the missile is equipped with a target seeking head which produces analog target deviation data or signals, hereinafter briefly called analog target seeking head, or a image processing target seeking head, the connection to the data bus at the carrier aircraft is made through a respective one of the interfaces. In the event that the missile produces a greater number of data or signals due to image processing of, for example, a larger field of view, this advantage can be utilized. In the event that the missile produces only a few data or signals from the analog target seeking head, also these data or signals can be processed, although the possibilities available are naturally correspondingly limited in such case.

In an advantageous development of the inventive interface arrangement, a first interface may be provided in a missile which is equipped with a image processing target seeking head, and connected to a missile data bus. The first interface is capable of converting complete data or signal sets which originate from the image processing target seeking head, into data or signals corresponding to the analog data or signals which originate from a missile equipped with an analog target seeking head. The second interface is capable of transmitting complete data or signal sets which originate from the image processing target seeking head, and editing such complete data or signal sets into data or signals for transfer through the aforesaid connecting cable to an interface on the side of the carrier aircraft and which carrier aircraft interface is adapted to receiving such data or signal sets. Switching means may be provided and controlled by the carrier aircraft interface; the first interface or the second interface of the missile thereby can be activated in dependence upon the type of interface which is present at the carrier aircraft. In this manner, the missile equipped with a image processing target seeking head can be used in conjunction with a carrier aircraft which as such is not adapted to processing data or signals which originate from a image processing target seeking head.

The first interface and the second interface on the side of the carrier aircraft may be selectively arranged either at the carrier aircraft or at the launcher.

BRIEF DESCRIPTION OF THE DRAWINGS

The invention will be better understood and objects other than those set forth above, will become apparent when consideration is given to the following detailed description thereof. Such description makes reference to the annexed drawings wherein the same or analogous components are designated by the same reference characters and wherein.

DETAILED DESCRIPTION OF THE PREFERRED EMODIMENTS

Figure 1:
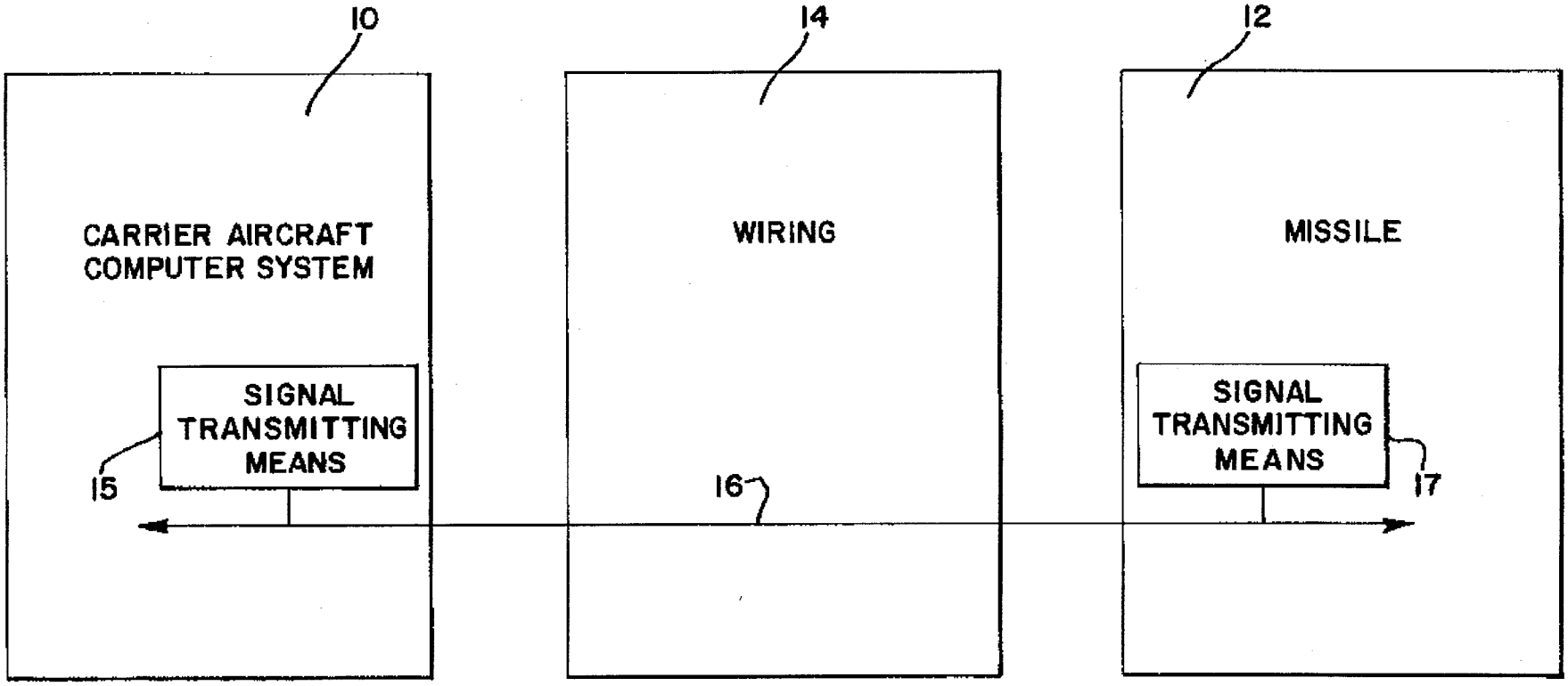
FIG. 1 is a schematic block diagram showing the basic set-up of the data or signal communication between a carrier aircraft and a missile.

Describing now the drawings, it is to be understood that only enough of the construction of the interface arrangement has been shown as needed for those skilled in the art to readily understand the underlying principles and concepts of the present development, while simplifying the showing of the drawings. Referring now specifically to FIG. 1 of the drawings, a computer or computer system on board the carrier aircraft is designated by the reference character 10. A missile to be launched from the carrier aircraft is designated by the reference character 12. The missile 12 and the carrier aircraft are interconnected by wiring 14 which is present at the carrier aircraft, and detachable connections.

The computer system 10 contains an interface arrangement for data or signal communication with the missile 12 for purposes of seeker slave-to-designator and target acquisition. The data or signal communication is symbolized by the double-headed arrow 16. The missile 12 includes an infrared-sensitive target seeking head, e.g. an analog target seeking head. Carrier aircraft signal transmitting means 15 are provided for transmitting to the missile 12, identifying signals indicative of whether the carrier aircraft computer system 10 is equipped for processing either analog target deviation data or image processing data. Furthermore, missile signal transmitting means 17 are provided for transmitting to the carrier aircraft computer system 10, identifying signals in the form of a digital code and indicative of whether the missile is equipped with either an analog target deviation data producing target seeking head or a image processing target seeking head.

Figure 2:
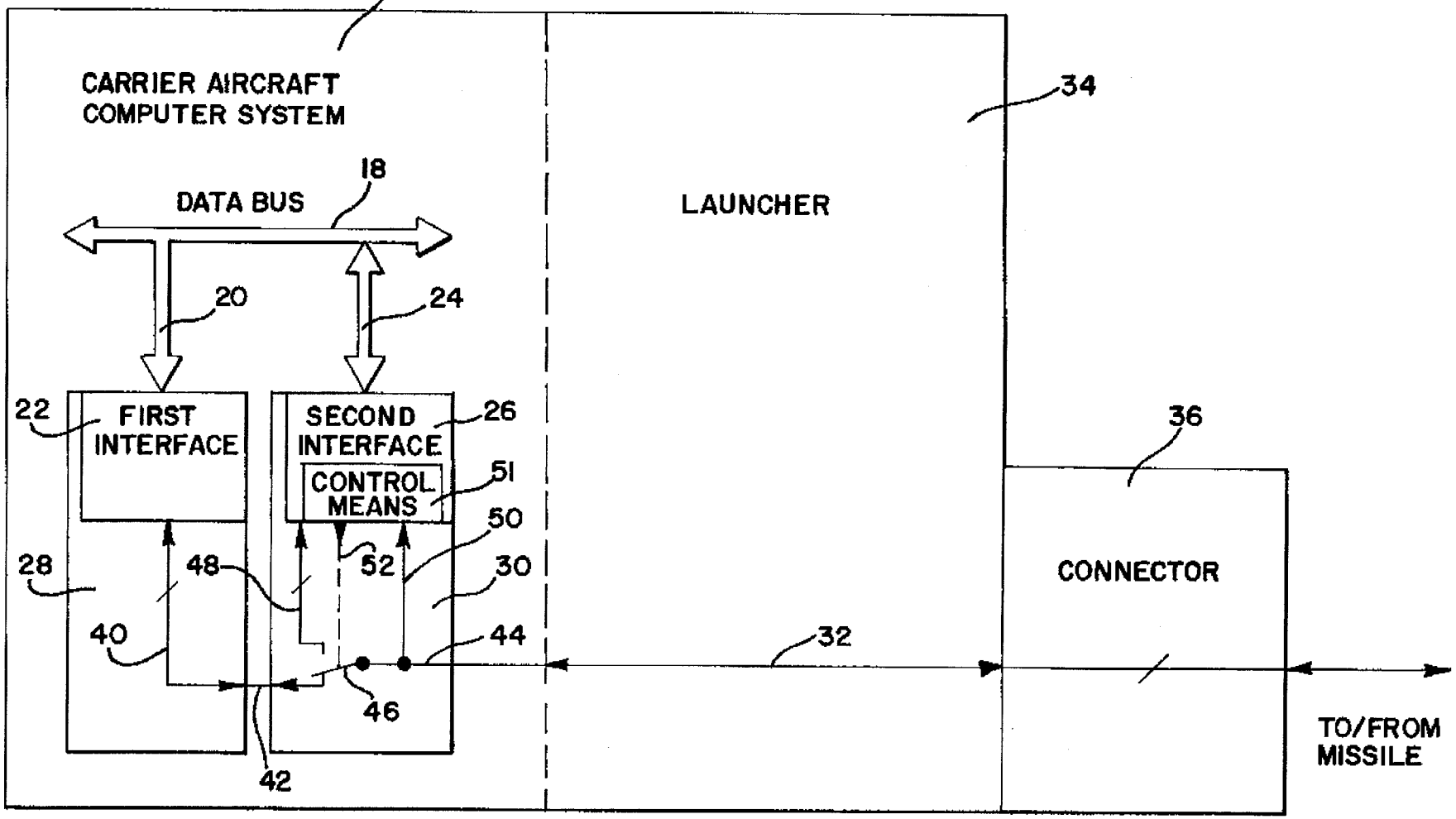
FIG. 2 is a schematic block circuit diagram showing a first exemplary embodiment of the inventive interface arrangement containing two interfaces immediately in a carrier aircraft for selectively launching missiles equipped with either an analog target seeking head or or a image processing target seeking head.

FIG. 2 depicts a first exemplary embodiment of the inventive interface arrangement and shows the equipment provided on the side of the carrier aircraft. The carrier aircraft computer system 10 contains a carrier aircraft data bus 18. A first carrier aircraft interface 22 is connected to the carrier aircraft data bus 18 through a data line 20. Furthermore, a second carrier aircraft interface 26 is connected to the carrier aircraft data bus 18 through a data line 24. The arrows at the data lines 20 and 24 indicate the data or signal flow direction from and to the carrier aircraft data bus 18 as utilized in the presently described exemplary embodiment. The first carrier aircraft interface 22 is located in a respective component or SEAM box 28 which operates in the sidewinder expanded acquisition mode (SEAM); the second carrier aircraft interface 26 is correspondingly located in a component or SEAM-E box 30 likewise operating in SEAM.

The first carrier aircraft interface 22 is designed in a manner which is known as such, for processing data or signals originating from the carrier aircraft computer system 10 and the carrier aircraft data bus 18, in order to produce data or signals which are transmitted through a three-wire detachable connecting cable 32 to a missile 12 of the AIM-9 type which is equipped with an analog target seeking head. The second carrier aircraft interface 26 is designed, on the one hand, for processing data or signals which arrive from the carrier aircraft computer system 10 via the data bus 18, in order to produce data or signals which are transmitted through the three-wire connecting cable 32 to a missile 12 of, for example, the FK 2 type which is equipped with a image processing target seeking head. On the other hand, the second carrier aircraft interface 26 is designed for processing data or signals which originate from the image processing target seeking head of the FK 2 missile and which are transmitted through the three-wire connecting cable 32 to the carrier aircraft data bus 18 and the carrier aircraft computer system 10. The connecting cable 32 extends via plug connections from the carrier aircraft to a launcher 34 which is mounted at the carrier aircraft, and from the launcher 34 to a connector or connecting member 36.

A section 40 of the three-wire connecting cable 32 extends within the component or SEAM box 28. The section 40 is connected to a further section 44 of the three-wire connecting cable 32 via a connection 42. The section 44 of the three-wire connecting cable 32 extends within the component or SEAM-E box 30. Carrier aircraft control means 51 is provided in the component or SEAM-E box 30. A corresponding input 50 is connected to the section 44 of the connecting cable 32. The carrier aircraft control means 51 include switching means in the form of a change-over switch 46 which is connected to a control output 52 of the carrier aircraft control means 51 and provided in the section 44 of the three-wire connecting cable 32. By means of the change-over switch 46, the three-wire connecting cable 32 may be disconnected from the connection 42 and thereby from the component or SEAM box 28 and connected to a three-wire cable section 48 which leads to the second carrier aircraft interface 26.

Figure 3:
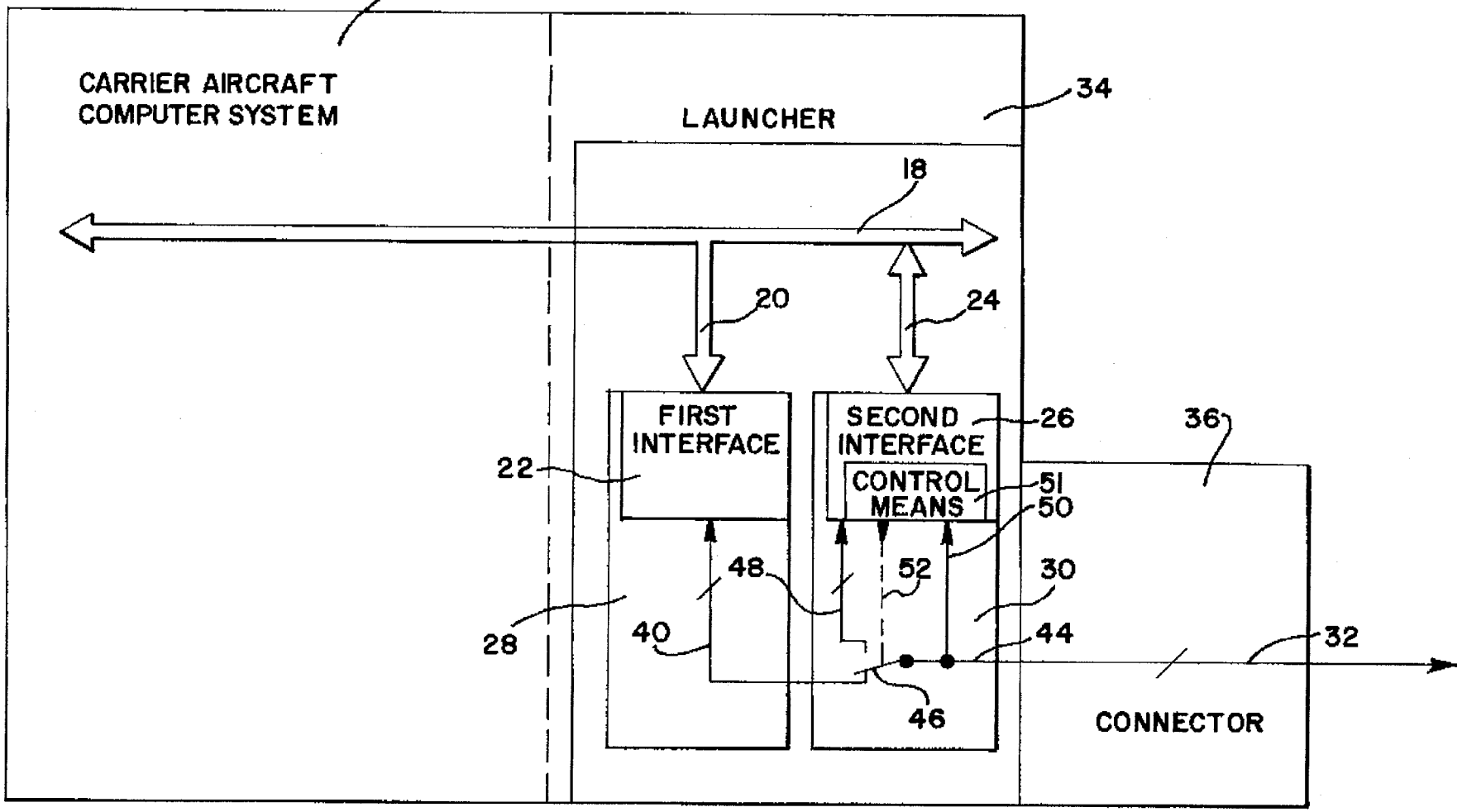
FIG. 3 is a schematic block circuit diagram showing a modified construction of the inventive interface arrangement as shown in FIG. 2 wherein the two interfaces are mounted at the launcher.

FIG. 3 shows a modified exemplary embodiment of the inventive interface arrangement which has a construction similar to that of the first exemplary embodiment as shown in FIG. 2.

In the modified exemplary embodiment as shown in FIG. 3, the components 28 and 30 respectively including the first carrier aircraft interface 22 and the second carrier aircraft interface 26 are not disposed within the carrier aircraft but, in fact, at the launcher 34. The function of the modified exemplary embodiment as illustrated in FIG. 3 is essentially the same as that of the interface arrangement as shown in FIG. 2.

Active missile signal transmitting means 17 is absent from the analog target seeking head. Consequently, no missile identifying signal is present at the input 50 of the carrier aircraft control means 51. This signal absence serves to identify the missile as being equipped with the analog target seeking head. In such event, the carrier aircraft control means 51 actuate the change-over switch 46 to assume a position in which the first carrier aircraft interface 22 is connected to the connecting cable 32. The interface arrangement thus is in the operative position as shown in FIG. 2.

Figure 5:
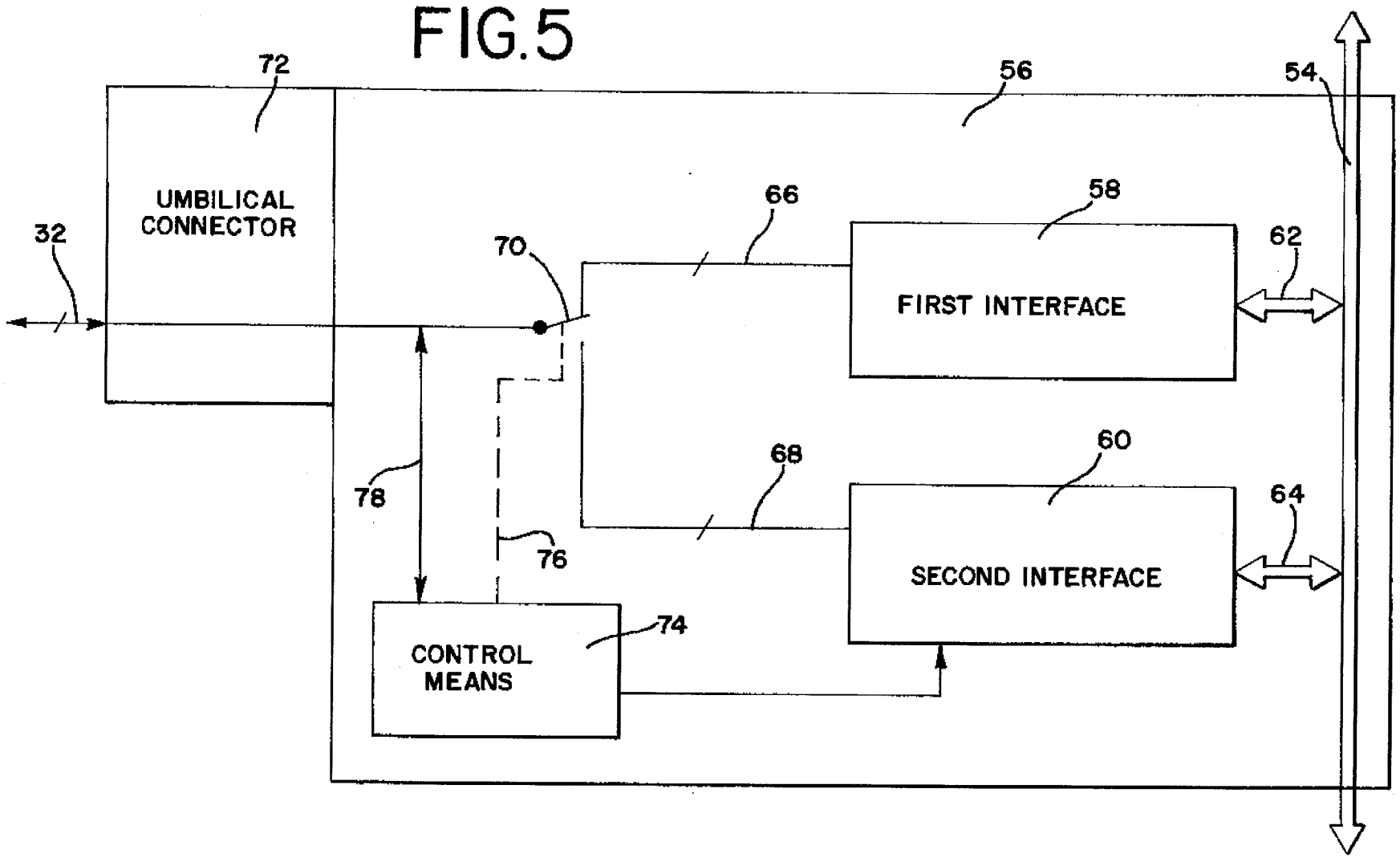
FIG. 5 is a schematic block circuit diagram showing a missile part of the inventive interface arrangement containing two interfaces in a missile equipped with a image processing target seeking head for selectively supplying, via the connecting cable and depending upon the equipment present at the carrier aircraft, either the complete data or signal sets originating from the image processing target seeking head or data or signals corresponding to the limited information supplied by an analog target seeking head.

The schematic block circuit diagram of FIG. 5 shows a second exemplary embodiment of the inventive interface arrangement provided on the side of the missile 12 which is constituted by an FK 2 missile equipped with a image processing target seeking head.

The FK 2 missile supplies and receives data or signals via a missile data bus 54. The interface arrangement of the FK 2 missile is generally designated by the reference character 56. The interface arrangement 56 contains a first missile interface 58 and a second missile interface 60. The first missile interface 58 is connected to the missile data bus 54 through a data line 62. The data line 62 transmits data or signals in both directions, i.e. from the missile data bus 54 to the first missile interface 58 as well as from the first missile interface 58 to the missile data bus 54. The second missile interface 60 is connected to the missile data bus 54 through a data line 64. The data line 64 transmits data or signals in both directions, i.e. from the missile data bus 54 to the second missile interface 60 as well as from the second missile interface 60 to the missile data bus 54.

The first missile interface 58 receives data or signals from the image processing target seeking head of the FK 2 missile and from a computer which is installed in the FK 2 missile. From such data or signals, the first missile interface 58 produces a limited data or signal set which corresponds to the limited data or signal set as supplied by an analog target seeking head (AIM-9L-SEAM data or signal set). Such data or signal set, as already explained hereinbefore, naturally includes much less information than the data or signal set actually supplied by a image processing target seeking head. Consequently, part of the information which originates from the image processing target seeking head, is lost when the data or signal set provided by the image processing target seeking head, is processed through the first missile interface 58. However, the thus produced limited data or signal set is intended to be used in conjunction with carrier aircraft equipped for operation in conjunction with missiles containing analog target seeking heads like the AIM-9L target seeking head.

In contrast therewith, the second missile interface 60 processes the full information supplied by the image processing target seeking head inclusive of data or signals concerning the missile status. These data or signals are processed and transmitted in a manner such that they can be transmitted through the three-wire connecting cable 32. In correspondence therewith, the second missile interface 60 receives prelaunch data or signals from the carrier aircraft through the connecting cable 32 which are converted into data or signals adapted to be processed by the missile data bus 54 and the missile computer.

The first missile interface 58 has an output which is formed by a three-wire cable section 66. The output of the second missile interface 60 is formed by a three-wire cable section 68. The connecting cable 32 can be selectively connected to either the cable section 66 or the cable section 68 by control means 74 including switching means in the form of a change-over switch 70 which is connected to the control means 74 through a control line 76. The connecting cable 32 is passed through an umbilical connector 72 which is detached upon launch of the FK 2 missile. The control means 74, in turn, receives a carrier aircraft identifying signal from the connecting cable 32 via a line or conductor 78. This carrier aircraft identifying signal is produced by carrier aircraft signal transmitting means 15, see FIG. 1, and indicates whether the carrier aircraft is adapted to process data or signals which originate from a image processing target seeking head or an analog target seeking head. In response thereto, the control means 74 actuate the change-over switch 70 to activate either the first missile interface 58 or the second missile interface 60.

Figure 4:
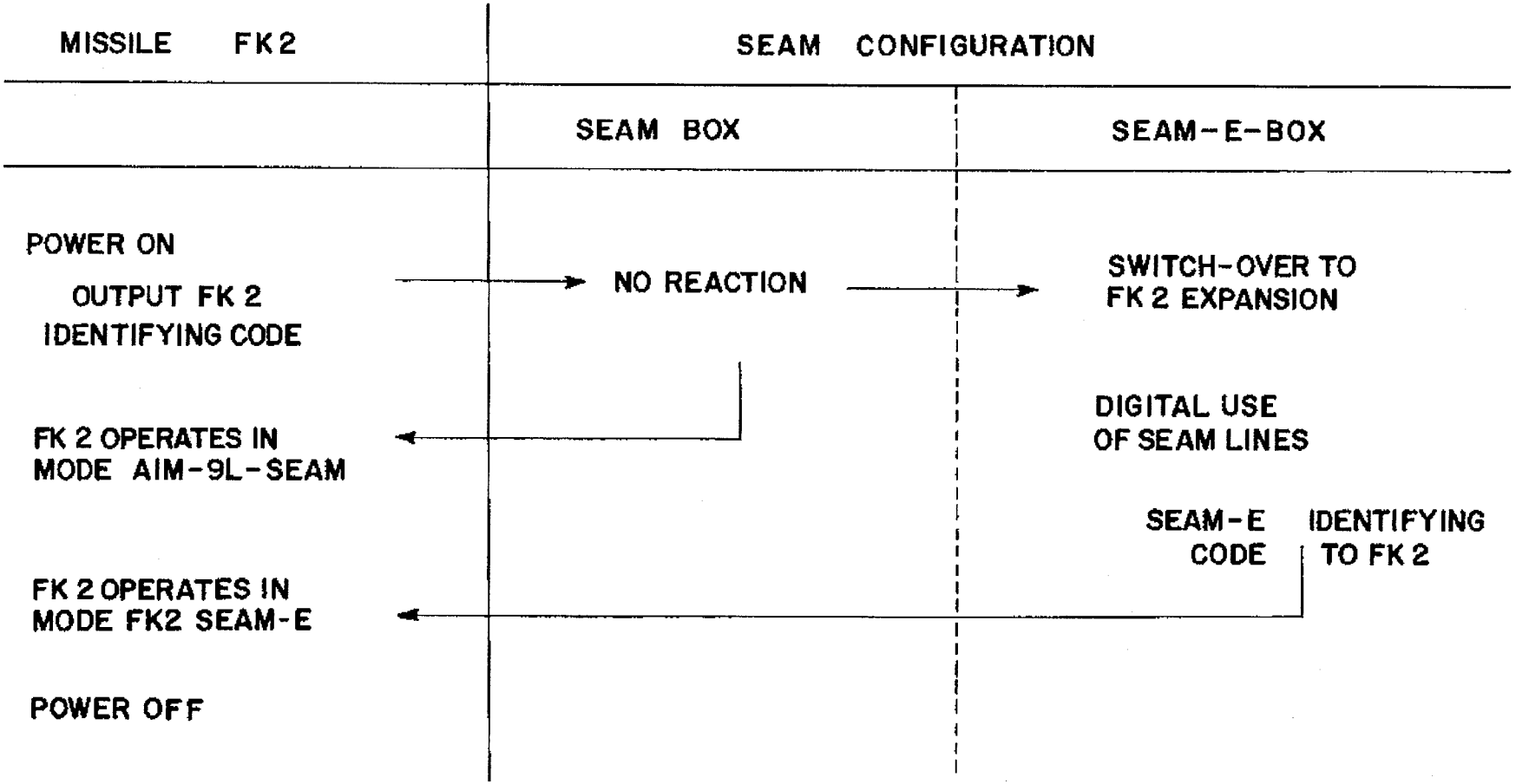
FIG. 4 illustrates the mode of operation of the interface arrangement as shown in FIGS. 2 and 3.

The mode of operation of the aforedescribed interface arrangement in a missile equipped with a image processing target seeking head and active missile signal transmitting means 17, is schematically illustrated in FIG. 4 and will now be described as follows:

Upon energization, the active missile signal transmitting means 17 produces a missile identifying signal which is in the form of a digital code and which is transmitted via the connecting cable 32 to the carrier aircraft interface arrangement. When the carrier aircraft is equipped only with the component 28 and thus is only adapted to process analog data or signals, which originate from an analog target seeking head, through the carrier aircraft interface 22, the missile identifying signal will not cause a response. The missile control means 74 reacts to the absence of the response by actuating the change-over switch 70 to assume a position in which the first missile interface 58 is connected to the connecting cable 32. As a result, the data or signal sets issued by the image processing target seeking head of the FK 2 missile are converted by the first missile interface 58 to the aforementioned limited data or signal sets which correspond to the analog data handled by the aircraft computer system through the first carrier aircraft interface 22.

Usually, the cable 32 contains three lines or conductors. In the analog mode, an analog reference signal is transmitted on one of the lines from the missile and has the form of a sine wave signal representing the rotation of the seeker rotor. Two other signals are respectively transmitted on the other two lines by the computer on the basis of information received from the carrier aircraft radar system; these two signals are sine waves which are 90° out of phase and which are indicative of target coordinates in an orthogonal coordinate system. The carrier aircraft radar system thereby is permitted to transmit data or signals regarding the target position to the target seeking head of the missile. Such data or signals can be used for generating precession signals which precess the seeker rotor towards the target as detected by the carrier aircraft radar system.

In the same manner, the target seeking head can transmit, to the carrier aircraft, data or signals regarding the deviation of the seeker optical axis from its central position or the target deviation from the seeker optical axis.

In the additional presence of the second component or SEAM-E box 30 in the carrier aircraft, the missile identifying signal produced by the missile signal transmitting means 17, is received by the carrier aircraft control means 51. The carrier aircraft control means 51 responds thereto by transmitting a response signal, i.e. the carrier aircraft control means 51, in effect, represents the carrier aircraft signal transmitting means 15 which transmit carrier aircraft identifying signals to the FK 2 missile. These signals indicate to the FK 2 missile that the carrier aircraft is adapted to process the complete data or signal sets issuing from the image processing target seeking head.

The carrier aircraft identifying signal which, again, is in the form of a digitally coded signal, is received by the missile control means 74 through the line or conductor 78. Upon receiving the response signal, the missile control means 74 actuate the change-over switch 70 via the control line 76 such as to assume a position in which the second missile interface 60 is connected to the connecting cable 32. Furthermore, the presence of the missile identifying signal at the carrier aircraft control means 51 has the effect that the carrier aircraft control means 51 actuate the change-over switch 46 to assume a position in which the second carrier aircraft interface 26 is connected to the connecting cable 32. As a result, the complete data or signal sets produced by the image processing target seeking head will be transmitted through the second missile interface 60, the connecting cable 32 and the second carrier aircraft interface 26 to the carrier aircraft data bus 18 and thus to the carrier aircraft computer system 10.

When the missile is equipped with an analog target seeking head, the active missile signal transmitting means 17 is absent and no missile identifying signal is applied to the carrier aircraft control means 51. As a result, the carrier aircraft control means 51 will actuate the change-over switch 46 to assume a position in which the first carrier aircraft interface 22 is connected to the connecting cable 32. As a further result, the absence of a response signal at the missile control means 74 will actuate the change-over switch 70 to assume a position in which the first missile interface is connected to the connecting cable 32. The thus formed operating configuration of this arrangement corresponds to the conventional analog mode of operation of a carrier aircraft in combination with a missile which is equipped with an analog target seeking head.

Actually, there are a total of four possible combinations: The aircraft may be merely equipped with means for processing analog signals from an analog seeker head of the missile. The aircraft may be equipped with means (SEAM-E) for processing digital information from an image processing seeker head. The missile may be equipped with either an analog seeker head or with a "digital", image processing seeker head. The combination of the "analog" seeker head with the "analog" processing means is the conventional system. The combination of the "analog" processing means with the "digital" seeker head permits only limited function of the system, as the interface has to convert the extended information from the digital, image processing seeker head to the limited information, like that provided by an analog seeker head. The aircraft will not transmit any identifying signal to the missile interface arrangement. The same is true, if, though the aircraft is equipped with analog with means for processing digital information from an image processing seeker head, the missile is equipped merely with a conventional analog seeker head. If eventually the missile provides digital image information and the aircraft contains means for processing such information, the full function of a digital image processing system can be utilized.

While there are shown and described present preferred exemplary embodiments of the invention, it is to be distinctly understood that the invention is not limited thereto, but may be otherwise variously embodied and practiced within the scope of the following claims. Accordingly,

What we claim is:

1. An interface arrangement for data transfer between a carrier aircraft and a missile which is to be launched from said carrier aircraft and includes a target seeking head, said interface arrangement comprising:

a carrier aircraft computer and a carrier aircraft data bus connected to said carrier aircraft computer;

a connecting cable containing a small number of wires for transferring analog data and interconnecting said carrier aircraft data bus and said target seeking head;

two interfaces interconnecting said carrier aircraft data bus and said connecting cable;

a target seeking head selectively constituting either (i) an analog target deviation data producing target seeking head or (ii) a image processing target seeking head;

a first one of said two interfaces enabling data transfer through said connecting cable between said analog target deviation data producing target seeking head and said carrier aircraft data bus;

a second one of said two interfaces enabling data transfer through said connecting cable between said image processing target seeking head and said carrier aircraft data bus; and control means connected to said connecting cable and controlling the connection of said connecting cable to either (i) said first interface or (ii) said second interface in dependence upon the respective presence of either (i) said analog target deviation data producing target seeking head or (ii) said image processing target seeking head in said missile.

2. The interface arrangement as defined in claim 1, further including:

missile signal transmitting means connected to said connecting cable and transmitting missile identifying signals indicative of the presence in said missile of either (i) said analog target deviation data producing target seeking head or (ii) said image processing target seeking head; and said control means receiving said missile identifying signals and including switching means for selectively connecting said connecting cable to either (i) said first interface or (ii) said second interface.

3. The interface arrangement as defined in claim 1, wherein said first interface and said second interface are disposed within said carrier aircraft.

4. The interface arrangement as defined in claim 1, wherein:

said carrier aircraft comprises a launcher for launching said missile;

said first interface and said second interface are disposed at said launcher; and said connecting cable being adapted to be disconnected from said missile upon launching said missile from said carrier aircraft.

5. The interface arrangement as defined in claim 2, wherein:

said missile signal transmitting means is operatively associated with said image processing target seeking head;

said switching means of said control means assuming a first position in which said second interface is connected to said connecting cable in the presence of said missile identifying signal; and said switching means of said control means assuming a second position in which said first interface is connected to said connecting cable in the absence of said missile identifying signal.

6. An interface arrangement for data transfer between a carrier aircraft and a missile which is to be launched from said carrier aircraft and includes a target seeking head, said interface arrangement comprising:

a carrier aircraft computer and a carrier aircraft data bus connected to said carrier aircraft computer;

a image processing target seeking head and a missile data bus operatively connected to said image processing target seeking head;

a connecting cable containing a small number of wires for transferring analog data and interconnecting said carrier aircraft data bus and said missile data bus;

two interfaces interconnecting said missile data bus and said connecting cable;

a first one of said two interfaces being adapted to convert complete data sets produced by said image processing target seeking head into analog data corresponding to analog target deviation data;

a second one of said two interfaces being adapted to process complete data sets produced by said image processing target seeking head for transmitting processed complete data sets received from said image processing target seeking head;

said carrier aircraft computer being adapted to selectively process either (i) analog target deviation data or (ii) image processing data received through said connecting cable; and missile control means connected to said connecting cable and selectively controlling the connection of said connecting cable to either (i) said first interface or (ii) said second interface in dependence upon said carrier aircraft computer being adapted to respectively process either (i) said analog target deviation data or (ii) said image processing data.

7. The interface arrangement as defined in claim 6, further including:

carrier aircraft signal transmitting means connected to said connecting cable and transmitting carrier aircraft identifying signals indicative of said carrier aircraft computer being adapted to respectively process either (i) said analog target deviation data or (ii) said image processing data; and said missile control means receiving said carrier aircraft identifying signals and including switching means for selectively connecting said connecting cable to either (i) said first interface or (ii) said second interface.

8. The interface arrangement as defined in claim 7, wherein:

said carrier aircraft signal transmitting means is operatively associated with said carrier aircraft computer adapted to process said image processing data;

said switching means of said missile control means assuming a first position in which said second interface is connected to said connecting cable in the presence of said carrier aircraft identifying signal; and said switching means of said missile control means assuming a second position in which said first interface is connected to said connecting cable in the absence of said carrier aircraft identifying signal.

9. An interface arrangement for data transfer between a carrier aircraft and a missile which is to be launched from said carrier aircraft and includes a target seeking head, said interface arrangement comprising:

a carrier aircraft computer and a carrier aircraft data bus connected to said carrier aircraft computer;

a target seeking head selectively constituting either (i) an analog target deviation data producing target seeking head or (ii) a image processing target seeking head;

a connecting cable containing a small number of wires for transferring analog data and interconnecting said carrier aircraft data bus and said target seeking head;

two carrier aircraft interfaces interconnecting said carrier aircraft data bus and said connecting cable;

a first one of said two carrier aircraft interfaces enabling analog data transfer from said connecting cable to said carrier aircraft computer;

a second one of said two carrier aircraft interfaces enabling digital data transfer from said connecting cable to said carrier aircraft computer;

carrier aircraft control means connected to said connecting cable and controlling the connection of said connecting cable to either (i) said first carrier aircraft interface or (ii) said second carrier aircraft interface;

two missile interfaces interconnecting said target seeking head and said connecting cable;

a first one of said two missile interfaces being adapted to convert complete digital data sets produced by said image processing target seeking head into analog data corresponding to analog target deviation data;

a second one of said two missile interfaces being adapted to process complete digital data sets produced by said image processing target seeking head; and missile control means connected to said connecting cable and selectively controlling the connection of said connecting cable to either (i) said first missile interface or (ii) said second missile interface in dependence upon said carrier aircraft computer being adapted to respectively process either (i) said analog target deviation data or (ii) said image processing data.

10. The interface arrangement as defined in claim 9, further including:

missile signal transmitting means connected to said connecting cable and transmitting missile identifying signals indicative of the presence of said image processing target seeking head;

said carrier aircraft control means receiving said missile identifying signals and thereby generating a response signal received by said missile control means;

said missile control means including switching means assuming, upon receipt of said response signal generated by said carrier aircraft control means, a first position in which said second missile interface is connected to said connecting cable; and said carrier aircraft control means including switching means assuming, upon receipt of said missile identifying signal, a first position in which said second carrier aircraft interface is connected to said connecting cable.

11. The interface arrangement as defined in claim 9, wherein:

said target seeking head constitutes an analog target deviation data producing target seeking head;

said carrier aircraft control means including switching means assuming, in the absence of a missile identifying signal, a second position in which said first carrier aircraft interface is connected to said connecting cable; and said missile control means including switching means assuming, in the absence of a response signal from said carrier aircraft control means, a second position in which said first missile interface is connected to said connecting cable.

* * * * *